United States Patent [19]

Stowe

[11] 4,221,313

[45] Sep. 9, 1980

[54] CARRYING APPARATUS

[76] Inventor: Alan A. Stowe, 5415 Winchester Ave., Ventnor, N.J. 08406

[21] Appl. No.: 932,091

[22] Filed: Aug. 8, 1978

[51] Int. Cl.[2] ..... B65D 71/00

[52] U.S. Cl. ..... 224/46 R; 297/183

[58] Field of Search ..... 224/55, 45 R, 45 F, 224/45 G, 45 I, 45 M, 45 P, 45 Q, 45 S, 45 W, 46 R, 52, 56, 50, 5 E; 297/184, 183; 248/359, 309 R, 316 R; 211/60, 62; 16/110 R, 125

[56] References Cited

U.S. PATENT DOCUMENTS

| | | | |
|---|---|---|---|
| 1,334,058 | 3/1920 | Sundell | 297/184 |
| 3,985,275 | 10/1976 | Allen | 224/45 S |

*Primary Examiner*—Kenneth W. Noland
*Attorney, Agent, or Firm*—Steele, Gould & Fried

[57] ABSTRACT

An apparatus for carrying at least one folding chair or the like, and a beach umbrella or the like, having a detachable shaft member, the apparatus comprising: at least two interlocking members for holding and for carrying the umbrella and the at least one chair; the detachable shaft member being positioned with respect to at least one of the interlocking members to serve as a carrying handle; and the at least one chair being positioned with respect to at least one of the interlocking members to coact as a securing means for the apparatus.

In one presently preferred embodiment, the apparatus comprises first, second and third substantially square, U-shaped members, having free ends, the free ends of the second and third members having corresponding openings, and each of the free ends of the first member being inserted through both openings of the other two members, substantially in the form of a cubic structure.

15 Claims, 9 Drawing Figures

CARRYING APPARATUS

BACKGROUND OF THE INVENTION

I. Field of the Invention

The subject invention relates to the field of apparatus for carrying disparate and/or bulky articles which are often used together, but which are difficult for one person to carry. In particular, the subject invention relates to an apparatus for conveniently carrying at least one folding chair or the like, and a beach umbrella or the like, the beach umbrella or the like having a detachable shaft member.

II. Description of Prior Art

One of the most common sights observed at any beach or similar picnic area is an individual struggling to carry several beach chairs and a beach umbrella, in addition to towels, suntan lotions, books, radios, and all of the other paraphernalia which people tend to carry with them when going to the beach or on a picnic. Even where there are many persons in a party, it is still difficult to conveniently carry all that must be carried. This is particularly true where children are included in the group.

In response to the long-felt need for easing the burden of people going to the beach, I have devised an apparatus, several embodiments of which are collapsible, which enables one person to very easily and conveniently carry a beach umbrella or the like and two folding chairs or the like, with one hand. The apparatus is extremely light, which results partially from the fact that the detachable shaft of the beach umbrella serves as a carrying handle for the apparatus, and one of the folding chairs carried by the apparatus serves as a securing means for the apparatus.

To the best of my knowledge, no such apparatus is known.

SUMMARY OF THE INVENTION

It is an object of this invention to provide an apparatus for conveniently carrying at least one folding chair or the like, and a beach umbrella or the like, the beach umbrella having a detachable shaft member.

It is a further object of this invention to provide an apparatus for carrying at least folding chair or the like, and a beach umbrella or the like, having a detachable shaft member, wherein the detachable shaft member serves as a handle for the apparatus, and wherein at least one folding chair serves as a securing means for the apparatus.

It is another object of this invention to provide an apparatus for carrying at least one folding chair or the like, and a beach umbrella or the like, the beach umbrella having a detachable shaft member, wherein the apparatus is collapsible into easily stored pieces.

Briefly, this invention is an apparatus for carrying at least one folding chair or the like, and a beach umbrella or the like, having a detachable shaft member, the apparatus comprising: at least two interlocking members for holding and providing means for carrying the umbrella and the at least one chair; the detachable shaft member being positioned with respect to at least one of the interlocking members to serve as a carrying handle; and, the at least one chair being positioned with respect to at least one of the interlocking members to coact as a securing means for the apparatus.

In one preferred embodiment, the apparatus comprises first, second and third substantially square U-shaped members, having free ends, the free ends of the second and third members having corresponding openings, and each of the free ends of the first member being inserted through both openings of the other two members, substantially in the form of a cubic structure; means for preventing disengagement of the first member after the insertion through the openings, whereby the at least one chair and the umbrella are supported within said cubic structure; and, means for engaging the detachable shaft on the second and third members, enabling the cubic structure, including the at least one chair and the umbrella, to be supported by the shaft, the shaft forming a convenient handle.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
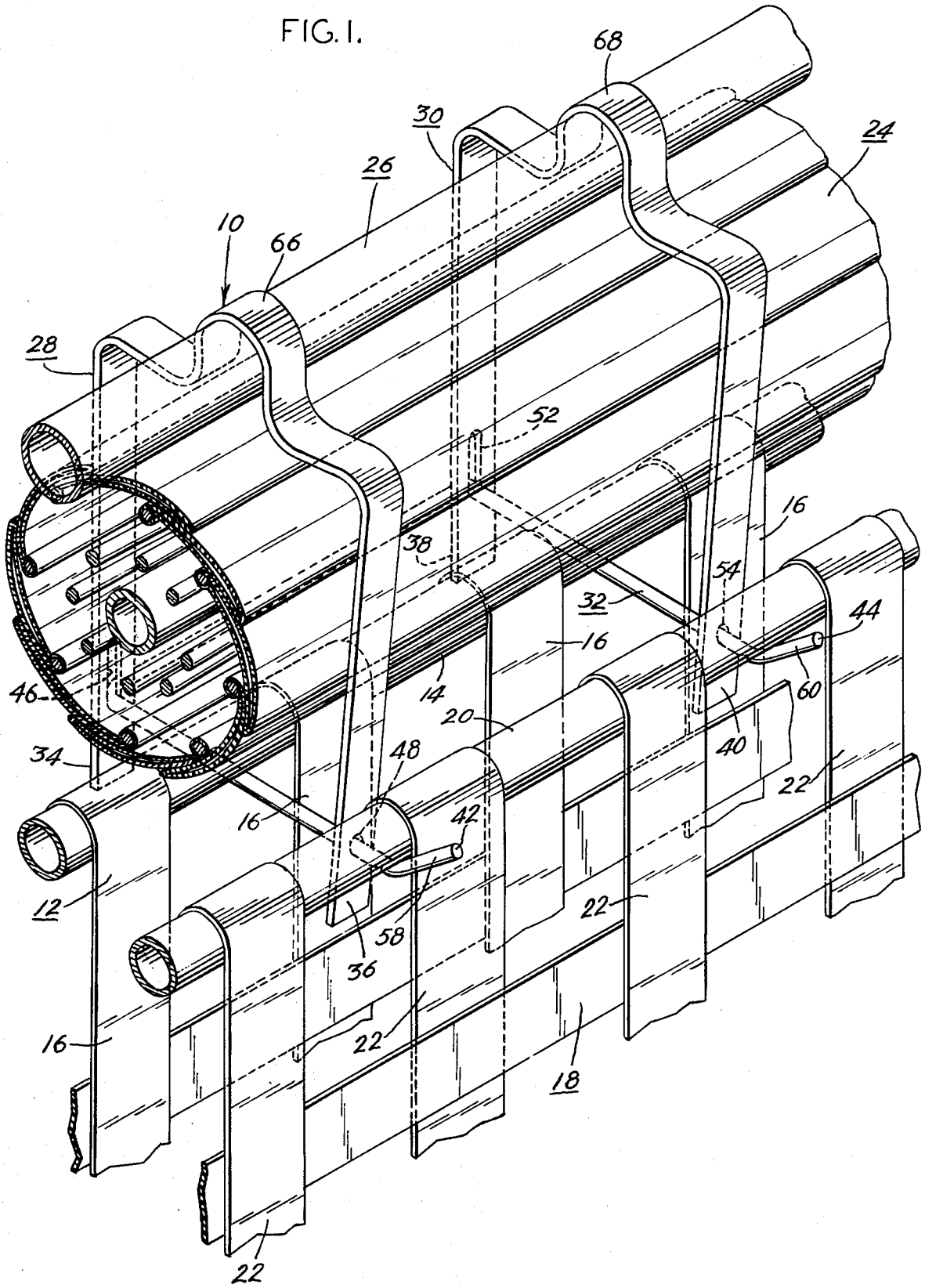
FIG. 1 is a perspective view of a carrying apparatus according to the present invention, as used to carry two folding chairs or the like and a beach umbrella or the like, the beach umbrella having a detachable shaft member, and one of the folding chairs or the like serving as securement means.

A carrying apparatus 10 according to the subject invention is shown in FIG. 1. The apparatus is suitable for carrying folding chairs or the like, two of which are designated by reference numerals 12 and 18, and a beach umbrella or the like 24, having a detachable shaft member 26. In the presently preferred embodiment, the apparatus 10 comprises first, second and third substantially square, U-shaped members 28, 30 and 32. When the members are interengaged as shown in FIGS. 1–5, they form a substantially cubic structure, with the folding chairs 12 and 18 hanging from member 32, and the umbrella 24 and shaft member 26 being confined in rectangles formed by corresponding portions of the members 28, 30 and 32. The section of shaft member 26 which is between members 28 and 30 serves as a carrying handle for the entire apparatus. In the arrangement shown in FIG. 1, chair 18 serves as a securing means for the apparatus. Another arrangement where this is not the case is shown diagrammatically in FIG. 4. In either instance, detachable shaft member 26 forms a carrying handle.

Figure 4:
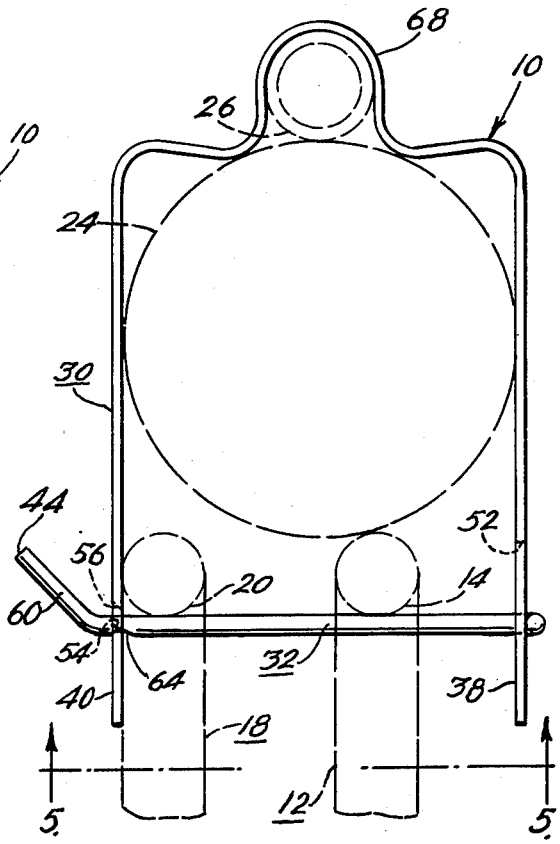
FIG. 4 is a side view of the apparatus shown in FIG. 2, depicting in schematic form an alternate arrangement for carrying at least two folding chairs or the like and a beach umbrella or the like, the beach umbrella or the like having a detachable shaft member.
Figure 6:
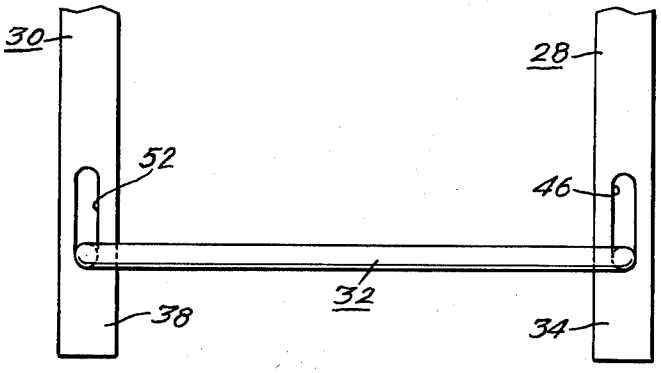
FIG. 6 is a fragmentary rear view of the apparatus shown in FIG. 2.

With further reference to FIGS. 2–5, members 28 and 30 may be formed from flat strips or straps, in the shape shown clearly in FIG. 4. Members 28 and 30 are substantially identical and interchangeable in use, and may be formed from aluminum stock. Although aluminum is presently preferred, the strap members 28 and 30 may be formed from other suitable materials, including stronger metals or plastics. Member 32 is preferably formed from aluminum rod stock, but may also be formed from other suitable metals or plastics. It has been found that strap members may be easily formed from one-eighth inch thick stock, the strap members being approximately three-quarters of an inch wide. The rod member 32 may be formed from one-quarter inch diameter stock. The foregoing dimensions are illustrative only, and should not be deemed to be limiting in any sense.

Figure 7:
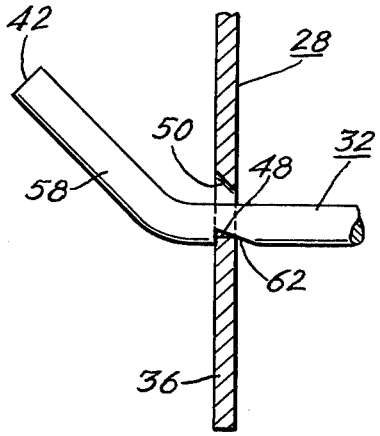
FIG. 7 is a section view taken along the line 7—7 in FIG. 3.
Figure 8:
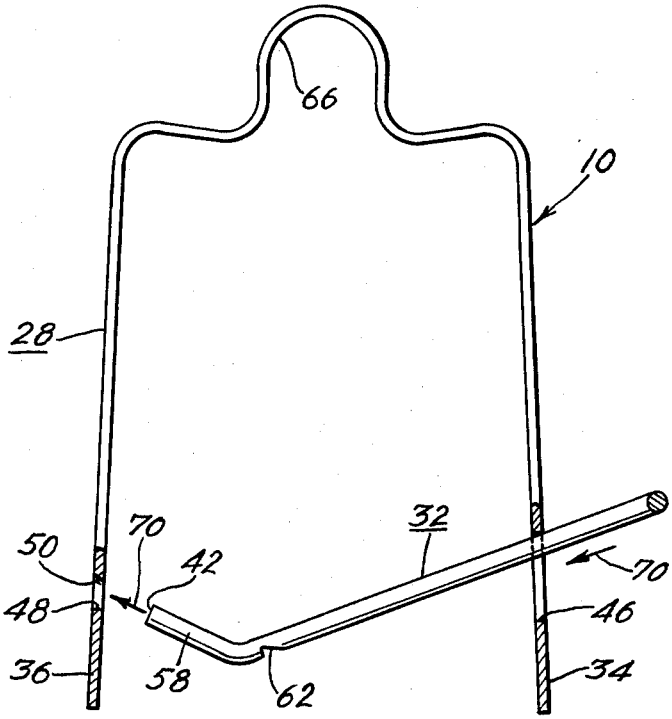
FIG. 8 is a fragmentary side view of a carrying apparatus according to the present invention, in partial section, demonstrating an intermediate step in loading and securing the subject invention; and, FIG. 9 is a perspective view, in diagrammatic form, of an alternative embodiment of a carrying apparatus according to the present invention.

Strap member 28 has free ends 34 and 36. Similarly, strap member 30 has free ends 38 and 40. For purposes of convenience, free ends 34 and 38 may be thought of as being disposed at the rear of the carrying apparatus, and free ends 36 and 40 may be thought of as being disposed at the front of the carrying apparatus. Free ends 34 and 40 are provided with openings 46 and 52, in the form of slots. Free ends 36 and 42 are provided with substantially circular openings 48 and 54 respectively. The upper portions of openings 48 and 54 are provided with beveled surfaces 50 and 56 respectively, as shown in FIGS. 4, 7 and 8.

Figure 2:
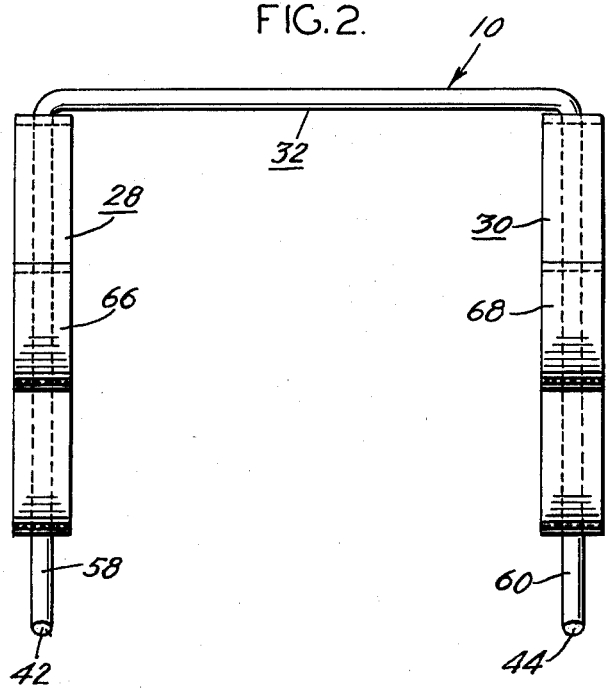
FIG. 2 is a top view of a carrying apparatus according to the present invention shown as used, but with the folding chairs or the like and the beach umbrella or the like omitted for purposes of clarification.
Figure 5:
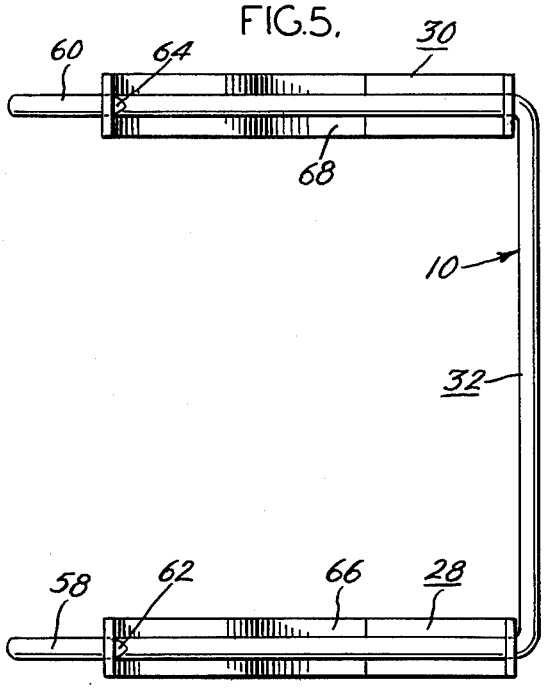
FIG. 5 is a view taken along the line 5—5 in FIG. 4, with the folding chairs or the like and the beach umbrella or the like omitted for purposes of clarification.
Figure 3:
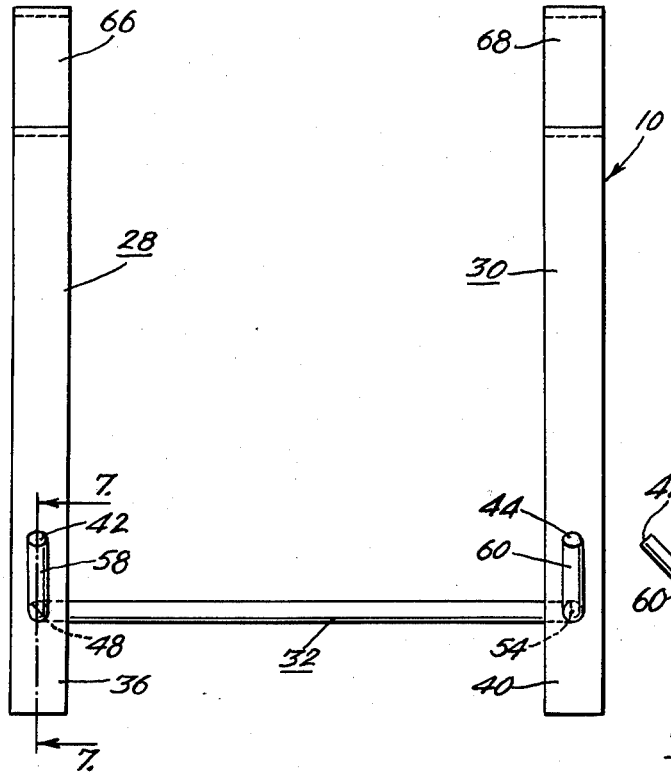
FIG. 3 is a front view of the apparatus shown in FIG. 2.

Rod member 32 is provided with free ends 42 and 44, designated in FIG. 2, in the form of upturned end structure 58 and 60, designated in FIGS. 1, 4, 5, 7 and 8. Rod member 32 is additionally provided with locking notches 62 and 64, adjacent upturned end structures 58 and 60 respectively. The locking notches are provided for engagement with corresponding portions of the structure forming openings 48 and 54 respectively.

Finally, strap members 28 and 30 are provided with arcuate structure 66 and 68 respectively, for engaging detachable shaft member 26 of umbrella 24, as depicted in FIGS. 1 and 4.

The carrying apparatus 10 may be used as shown in FIG. 1 or FIG. 4. In either instance, strap members 28 and 30 are disposed opposite one another, with slots 46 and 54 disposed in the rear and openings 48 and 54 disposed in the front. The free ends of rod member 32 are first inserted through slots 46 and 52, in the direction shown by arrows 70, as shown in FIG. 8. Upturned end structure and 60 is turned up with respect to free ends 34, 36, 38 and 40, which may be thought of as being disposed at the bottom of the carrying apparatus. While the free ends 42 and 44 of rod member 32 are disposed between the free ends of the strap members, one or more folding chairs may be slipped over the arms of rod member 32, as shown in FIGS. 1 and 4 respectively. With reference to FIG. 1, it is clear that rod member 32 engages frame members 14 and 20 of chairs 12 and 18 respectively, passing between elements of the webbing 16 and 22, which forms the back and seat (not shown) of the chairs. After one or more chairs are so engaged, the free ends 42 and 44 are inserted through openings 48 and 54. This engagement is facilitated by the play provided by the slots 46 and 52 and by the beveled portions 50 and 56 of openings 48 and 54. After the upturned end structure of rod member 32 has been fully inserted through the openings 48 and 54, insertion is completed when notches 62 and 64 engage the bottom of the structure forming openings 48 and 54, as shown in FIG. 7. The weight of one or more chairs resting on rod member 32, in conjunction with the flexibility of the strap members, ensures a positive locking engagement. For this reason, the carrying apparatus may be used as shown in FIG. 4. Alternatively, the carrying apparatus may also be secured by placing one folding chair or the like in the space between the upturned end structure 58 and 60 of rod member 32 and the adjacent free ends 36 and 42 of strap members 28 and 30. This arrangement is clearly shown in FIG. 1. This securement means is effective even without the locking engagement which might otherwise be provided by the notches 62 and 64.

Irrespective of the arrangement chosen for the disposition of the folding chairs, the umbrella 24 is placed within the cubic structure defined by members 28, 30 and 32, as shown in FIGS. 1 and 4. The detachable shaft member 26 is slid into the openings formed by arcuate structure 66 and 68, being supported on the bottom by the umbrella 24. Once the apparatus is loaded and secured, as shown in either FIG. 1 or 4, one need only grasp detachable shaft member 26, between strap members 28 and 30, and pick up and carry the apparatus.

Unloading of the carrying apparatus is accomplished by removing the umbrella 24 and detachable shaft member 26; the securement means are released, by disengaging the notch structure as shown in FIG. 4 or by removing chair 18 as shown in FIG. 1; by slipping the free ends of rod member 32 back out of openings 48 and 54, such disengagement being facilitated by the beveled structure of the openings and the slots; by disengaging rod member 32 from the remaining supported chairs; and, by completely disengaging rod member 32 from the strap members 28 and 30, through slots 46 and 52.

Figure 9:
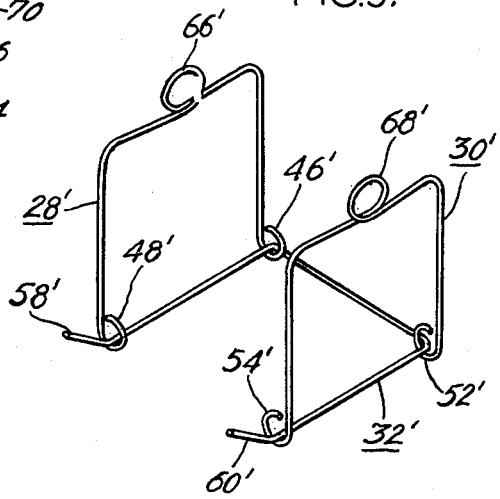

An alternate embodiment of the carrying apparatus is shown diagrammatically in FIG. 9, wherein all of the interlocking members are formed from rod stock. With reference to FIG. 9, strap members 28 and 30 are replaced by first and second rod members 28' and 30', each of which may be formed from one continuous rod by appropriate bending. Rod member 28' is provided with opening 48', opening 46' in the form of a slot, and arcuate structure 66'. Rod member 30' is provided with opening 54', opening 52' in the form of a slot, and arcuate structure 68'. Rod member 32' is similar in most respects to rod member 30, being provided with upturned end structure 58' and 60'. However, in view of the circular cross-section of members 28' and 30', the equivalent locking notch structure of rod member 32' would more appropriately be round, rather than the triangular configuration shown in FIG. 7. The carrying apparatus shown in FIG. 9 may be used in the same fashion as that shown in FIG. 1–8.

As another alternative embodiment, it is also contemplated to form strap members 28 and 30 into one member. This may easily be accomplished by any number of permanent connecting members between the two strap members. This embodiment would sacrifice the complete collapsibility of the previously discussed embodiments, but it would be easier to manipulate, a distinct advantage for the young or infirm.

The present invention may be embodied in other specific forms without departing from the spirit or essential attributes thereof, and accordingly, reference should be made to the appended claims, rather than to the foregoing specification as indicating the scope of the invention.

I claim:

1. An apparatus for carrying at least one folding chair or the like, and a beach umbrella or the like, having a detachable shaft member, the apparatus comprising:

first, second and third substantially square, U-shaped members, having free ends, the free ends of the second and third members having corresponding openings, and each of the free ends of the first member being inserted through both openings of the other two members, the members defining edges of a substantially cubic structure;

means for preventing disengagement of said first member after said insertion through said openings, whereby said at least one chair and said umbrella are supported within said cubic structure; and, means for engaging said detachable shaft member on said second and third members, enabling said cubic structure, including said at least one chair and said umbrella, to be supported by said shaft, said shaft forming a convenient handle.

2. The apparatus of claim 1, wherein said means for preventing disengagement are formed by upturned end structure on said first member.

3. The apparatus of claim 1 or 2, wherein the means for preventing disengagement includes notches on the first member, adjacent the free ends thereof, said notches being engageable with structure forming the openings in the adjacent free ends of the second and third members.

4. The apparatus of claim 2, wherein the means for preventing disengagement further includes another folding chair or the like, supported on said upturned end structure, outside of said cubic structure.

5. The apparatus of claim 1, wherein the means for engaging the detachable shaft includes arcuate structure.

6. The apparatus of claim 1, wherein one opening on each of said second and third members is slotted, facilitating insertion of the free ends of the first member through the other opening on each of said second and third members.

7. The apparatus of claim 1 or 6, wherein one of the openings on each of the second and third members is substantially circular and includes beveled structure for facilitating insertion of the free ends of the first member therethrough.

8. The apparatus of claim 1, wherein said first member is a rod and said second and third members are straps.

9. The apparatus of claim 1, wherein said first, second and third members are rods.

10. The apparatus of claim 9, wherein one of said at least two interlocking members is a rod and the other is a strap.

11. The apparatus of claim 9, wherein said at least two interlocking members are rods.

12. An apparatus for carrying at least one folding chair or the like, and a beach unbrella or the like, having a detachable shaft member, the apparatus comprising:

at least two interlocking members for holding and providing means for carrying said unbrella and said at least one chair;

said detachable shaft member being positioned with respect to at least one of said interlocking members to serve as a carrying handle; and, said at least one chair being positioned with respect to at least one of said interlocking members to act as a means for securing said interlocking members.

13. The apparatus of claim 12, wherein one of said at least two interlocking members has free ends and the other has pairs of openings for engagement with said free ends.

14. The apparatus of claims 12 or 13 wherein one of said at least two interlocking members has arcuate structure for engaging said detachable shaft member.

15. The apparatus of claims 12 or 13, further comprising a third interlocking member for holding and providing means for carrying said umbrella and said at least one chair, said at least one chair being positioned with respect to two of said interlocking members to act as said securing means.

* * * * *